United States Patent [19]

Schmitt

[11] Patent Number: 4,706,059

[45] Date of Patent: Nov. 10, 1987

[54] ELECTRICAL FUSE ASSEMBLY

[75] Inventor: Fritz Schmitt, Russelsheim, Fed. Rep. of Germany

[73] Assignee: General Motors Corporation, Detroit, Mich.

[21] Appl. No.: 876,772

[22] Filed: Jun. 20, 1986

[30] Foreign Application Priority Data

Aug. 24, 1985 [DE] Fed. Rep. of Germany ..... 3530354

[51] Int. Cl.[4] ..... H01H 85/04

[52] U.S. Cl. ..... 337/297; 337/283

[58] Field of Search ..... 337/297, 283

[56] References Cited

U.S. PATENT DOCUMENTS 3,875,542 4/1975 Holland et al. ..... 337/297

4,394,639 7/1983 McGalliard ..... 337/297

*Primary Examiner*—Harold Broome

*Attorney, Agent, or Firm*—Patrick M. Griffin

[57] ABSTRACT

A vehicle electrical fuse assembly of the type having replacable fuses and a fuse holder is improved by providing printed conductors on a flexible film to serve as the fuses, and clamping the film to the holder with a releasably attached cover. The fuses may be easily replaced by removing the cover and replacing the film. The fixed position of the printed conductors precludes improper positioning of the replaced fuses.

3 Claims, 3 Drawing Figures

ELECTRICAL FUSE ASSEMBLY

This invention relates to electrical fuse assemblies in general, and specifically to a fuse assembly for use in motor vehicles and comprised of a plurality of replaceable fuses and a fuse holder.

BACKGROUND OF THE INVENTION

One fuse resistance which has heretofore been proposed (DE-OS No. 26 11 819) is comprised of an insulating substrate, a resistance wire of a given resistance value and terminal wires which are in electrical contact with the resistance wire. The substrate is made up of a piece of plastic foil, and the substrate foil is coated on one side with a resistance layer and a plurality of low-resistance contact layers. The resistance wire is interposed between two contact layers, and a cover foil made of thermoplastic material is placed on top. The terminal wires are fused through the cover foil so as to establish electrical contact with the contact layers and the resistance wire and to fix the substrate, cover foil resistance wire and terminal wires into position. The substrate foil is made of a thermoplastic material, such as polyethylene terephtalate, polycarbonate, polysulfon, but may also be made of a non-thermoplastic material, such as polymide. The resistance layer is made of a chrome-nickel alloy, the contact layers are made of aluminum, zinc, copper or gold, the resistance wire is made of constanston (copper-nickel), and the cover foil is made of polyethylene terephtalate. However, because of the many components that are needed, this prior art fuse resistance is complex in structure and expensive to manufacture. Furthermore, each fuse must be inserted separately into the fuse box, a procedure which is cumbersome and time-consuming. There is also the possibility of mistaking one fuse for another and installing a fuse of the wrong amperage in a circuit, which may result in short circuits and cause damage to expensive electronic components or equipment.

SUMMARY OF THE INVENTION

It is an object of the present invention to improve and simplify this prior art arrangement and to provide a fuse assembly that is simple to handle and which eliminates the possibility of making mistakes when replacing fuses. In accordance with the invention, this object is achieved in that a plurality of printed conductors, which are arranged parallel to one another on a foil, are provided to serve as fuses, and in that the foil is adapted to be clamped into a base which is provided with terminals for the printed conductors.

One advantage of the arrangement proposed by the present invention is that the possibility of fuse mix-ups are eliminated, because the respective positions of the fuses are fixed in the base, so that installation of the fuses in their proper sequence is assured. Fuse replacement is very simple, and strips of fuses can be wound up on rolls and sold by the foot or yard. By virtue of its simple structure, the fuse assembly proposed by this invention is inexpensive in manufacture and is easy to handle. Furthermore, the subject fuse arrangement provides for clearness in arrangement and is easy to inspect.

According to a further feature of the invention, a transparent lid is provided which can be clamped to the fuse support member. The transparent lid is designed to retain the foil containing the fuses in position, to cover the conductors and to press the contact surfaces to one another.

The foil and the support member are provided with locating marks to ensure proper insertion of the foil into the support member.

DESCRIPTION OF THE PREFERRED EMBODIMENT

These and other features and advantages of the invention will appear from the following drawings and the written description, wherein.

The carrier foil or flexible film 1, which is made of plastics, especially PVC, is provided with conductors 2, which are applied thereto by a suitable laminating, vacuum metallizing, embossing, hot rolling or substraction technique. The conductors 2 extend parallel to each other and their number depends on the number of circuits to be protected. The conductors are terminated at either end into tabs 3 and 4 which are disposed at the edge of the foil 1 and which are larger in width than the conductors 2. The width and thickness of the individual conductors 2 depends on the amperage of the respective fuse.

Figure 1:
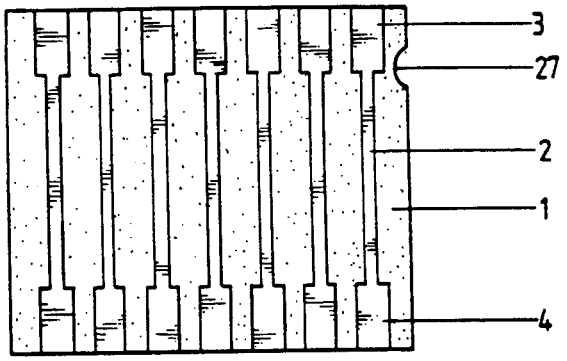
FIG. 1 is a plan view of a foil containing printed conductors which serve as fuses.
Figure 2:
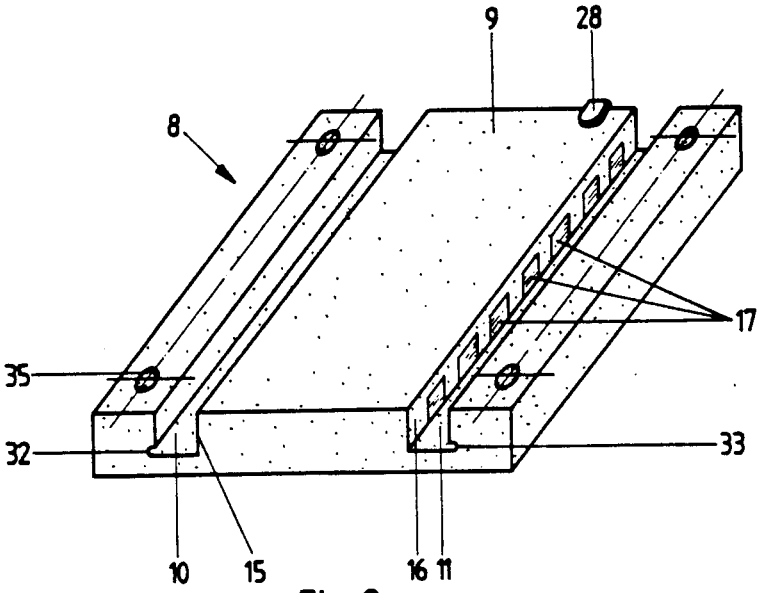
FIG. 2 is a perspective view of the support member for the foil according to FIG. 1.

The foil 1 is clamped onto the base 8 illustrated in FIG. 2. The base 8 is comprised of a board 9 into which are machined two parallel extending grooves 10 and 11. The inwardly disposed walls 15, 16 of the grooves 10 and 11 are provided with terminals 17 which are adapted to be electrically engaged or contacted with the tabs 3 and 4 of the foil 1. The terminals 17 are in electrical communication with the circuits to be protected by the fuses.

Figure 3:
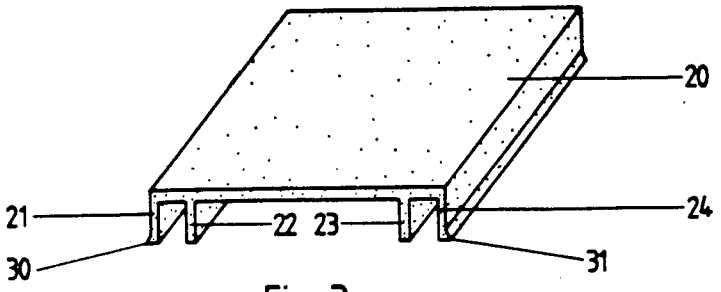
FIG. 3 is a transparent lid which is clamped onto the support member and which serves to retain the foil in position.

A transparent lid 20 illustrated in FIG. 3 serves as a means to clamp the foil 1 to the base 8. The lid 20 ensures that the foil 1 is retained flat on top of the board 9. It also serves to protect the conductor strips 2 against damage and to prevent entry of dust and dirt. Since the lid 20 is transparent, visual inspection of the fuses is relatively easy. The lid 20 has four perpendicularly extending clamping legs 21 to 24 formed thereon which are adapted to engage into the grooves 10 and 11 and to bear against the walls thereof, so that when the lid 20 is applied to the board 9 the foil 1 is stretched over the board 9 and the tabs 3 and 4 are urged against the terminals 17. A circular cut-out 27 at the edge of the foil 1, and a correspondingly shaped raised portion 28 at the edge of the board 9 are provided so as to be placed in mating relationship. This will ensure that the foil 1 is properly located on the board 9. To achieve a proper fit of the lid 20 on the board 9, the two outer legs 21 and 24 of the lid 20 are provided at their lower free ends with outwardly projecting ribs 30 and 31 which are adapted to engage, respectively, into undercuts 32 and 33 at the bottom of grooves 10 and 11. The board 9 has bores 35 arranged at the corners thereof to enable the board to be mounted to a support by means of threaded bolts.

Foil 1 with the conductor strips 2 may be fabricated in the form of bands which are then wound onto rolls and sold by the foot or yard. This would permit a set of fuses to be cut off the roll with a pair of scissors. To facilitate separation of a set or sets of fuses from the roll, the foil may be provided with perforations. The foil 1 may be provided with conductor strips 2 on both sides. Then, in the event of a short circuit, the foil 1 can be turned over and the conductor strips 2 on the other side of the foil to be used. The fuse arrangement described in the foregoing is suitable for use as an integral element in instruments, electronic modules, or the like, and in this case the board 9 may also assume the function of a mounting block. The invention has been described in the foregoing by way of an exemplary embodiment illustrated in the drawings. It should be appreciated that a variety of arrangements may be utilized in the practice of the invention without departing from the over-all concept outlined in the foregoing.

The embodiments of the invention in which an exclusive property or privilege is claimed are defined as follows:

1. In a vehicle electrical fuse assembly of the type having a replaceable fuse and a fuse holder, the improvement comprising, a flexible carrier film, a printed conductor applied to said film to serve as said replaceable fuse, electrical terminals connected to said fuse holder and adapted to make electrical contact with said printed conductor, and removable clamping means for clamping said film to said holder and for flexing said film so as to urge said printed conductor into electrical contact with said terminals to complete said fuse assembly, whereby said fuse may be easily replaced by removing said clamping means and replacing said film.

2. In a vehicle electrical fuse assembly of the type having replaceable fuses and a fuse holder, the improvement comprising, a flexible carrier film, a plurality of printed conductors applied to said film parallel to each other in a fixed relative position to serve as said replaceable fuses, electrical terminals connected to said fuse holder and adapted to make electrical contact with said printed conductors, and removable clamping means for clamping said film to said holder so as to stretch said film and thereby electrically contact said printed conductors with said terminals to complete said fuse assembly, whereby said fuses may be easily replaced by removing said clamping means and replacing said film, with the fixed relative position of said printed conductors assuring the proper positioning of said replaced fuses.

3. In a vehicle electrical fuse assembly of the type having replaceable fuses and a fuse holder, the improvement comprising, a board to serve as said holder and having a pair of parallel grooves, each groove having an inner an an outer wall, a flexible carrier film sized so as to fit on said board between said groove inner walls and overlapping said groove inner walls, a plurality of printed conductors applied to said flexible film parallel to each other in a fixed relative position to serve as said replaceable fuses, electrical terminals connected to said inner walls of said parallel grooves and adapted to make electrical contact with the ends of said printed conductors, and, a cover including two pairs of parallel inner and outer perpendicularly projecting legs, one pair respective to each groove, so that as said leg pairs are pushed into said respective grooves after said carrier film is fitted thereon, said inner legs clamp said overlapping flexible film against said groove inner walls to thereby electrically contact the ends of said printed conductors with said terminals while said outer legs releasably engage said groove outer walls to removably attach said cover to said holder and complete said fuse assembly, whereby said fuses may be easily replaced by removing said cover and replacing said film, with the fixed relative position of said printed conductors assuring the proper positioning of said replaced fuses.

* * * * *